US006155893A

United States Patent [19]

Belmont

[11] Patent Number: 6,155,893

[45] Date of Patent: Dec. 5, 2000

[54] LIFT-GENERATING DEVICE FOR A POWER BOAT

[76] Inventor: Michael Richard Belmont, Exeter, United Kingdom

[21] Appl. No.: 09/194,023

[22] PCT Filed: Jun. 16, 1997

[86] PCT No.: PCT/GB97/01610

§ 371 Date: Nov. 19, 1998

§ 102(e) Date: Nov. 19, 1998

[87] PCT Pub. No.: WO97/48597

PCT Pub. Date: Dec. 24, 1997

[51] Int. Cl.[7] ..... B63H 1/18

[52] U.S. Cl. ..... 440/66; 440/71

[58] Field of Search ..... 440/49, 71, 66, 440/67; 114/281

[56] References Cited

U.S. PATENT DOCUMENTS

| | | | |
|---|---|---|---|
| 899,359 | 9/1908 | Wadagaki | 440/67 |
| 2,896,565 | 7/1959 | Stevens | 440/66 |
| 3,099,240 | 7/1963 | Montague | 114/281 |
| 3,768,432 | 10/1973 | Spaulding | 440/66 |

*Primary Examiner*—S. Joseph Morano
*Assistant Examiner*—Lars A. Olson
*Attorney, Agent, or Firm*—Melvin I. Stoltz

[57] ABSTRACT

A lift-generating device for a power boat includes a boundary (4) of semi-circular form in cross section mounted beneath the propeller (5) of the boat so that the propeller (5) produces a high-speed water flow over the upwardly facing surface of the boundary (4), thereby creating lift.

12 Claims, 12 Drawing Sheets

LIFT-GENERATING DEVICE FOR A POWER BOAT

This application is based upon PCT International Application No. PCT/GB97/01610, filed on Jun. 16, 1997 claiming foreign priority benefits of Great Britain Patent Application No. 9612920.0, filed Jun. 20, 1996.

FIELD OF THE INVENTION

This invention relates to power boats.

BACKGROUND TO THE INVENTION

When starting from rest or low speeds, a boat designed to operate in a planing mode must make a transition from conditions in which a large part of the hull is immersed in the water (under which conditions, the boat generates a large wave/displacement drag) to a situation in which the hydrodynamic forces on the hull of the boat caused by its motion through the water cause much of the vessel to be raised out of the water, thereby reducing drag and allowing the attainment of high speeds under planing conditions.

Some craft exhibit an undesirable attitude in the water which prevents or limits the rapid achievement of this transition. This can be due to a variety of reasons; for example, the craft may be stern heavy or the craft may be towing a water skier from rest, thereby pulling down the stern of the craft. If the boat is under-powered, it may be unable to make the transition to planing effectively, or it may take considerable time to do so.

To overcome these problems, wing-type lift-generating devices are often fitted to boats, typically to the submerged part of the propulsion unit. Flow-deflecting plates are also frequently placed on the rear of the transom of a boat.

The intention of both these types of equipment is to increase the lift force at the stern of the boat. This partly increases the overall lift on the hull but, more importantly, changes the attitude of the boat in order to reduce the drag at lower speeds, thereby allowing an easier and more rapid transition to the planing mode.

Such devices are frequently employed, the wing-type operating in the same manner as rather inefficient aircraft wings. The deflector plates produce lift by changing the direction of the flow caused by the motion of the boat in the same way that the planing hull of the boat creates lift. Both wings and deflectors require movement of the boat through the water in order to function and, with both types of device, the lift increases with increasing speed of the boat through the water. Both types of device are thus least effective when lift at the stern is most needed, i.e., when the boat is stationery or is moving very slowly. In fact, it could be advantageous to have the reverse lift/speed relationship, i.e. for the lift produced by a lift-generating device to be at a maximum when the boat is at rest and either stay constant or reduce in some manner as the boat approaches its operational speed.

It is accordingly an object of the present invention to provide an improved form of lift-generating device for a boat, particularly one which provides maximum lift when the boat is at rest or moving slowly through the water.

SUMMARY OF THE INVENTION

According to a first aspect of the present invention there is provided a lift-generating device for a boat having a flow generator for generating a high-velocity stream of water, which device includes a boundary having an upwardly facing surface over which said high-velocity stream of water is caused to flow at a velocity greater than any flow of water under the lower surface of said boundary.

The flow generator may be the main propulsion unit of the boat, for example, a propeller or a jet propulsion unit.

According to a second aspect of the present invention there is provided a method of creating lift for a boat having a flow generator for generating a high-velocity stream of water, which method comprises providing a boundary having an upper surface and a lower surface and positioning the boundary relative to the flow generator in such manner that, in operation of the flow generator, the high-velocity stream of water is caused to flow over the upper surface of the boundary at a velocity greater than any flow of water under the lower surface of the boundary.

Said boundary is preferably of arcuate form in a plane transverse to the direction of flow of said high-velocity stream of water. For example, the boundary may be of semicircular form in transverse cross-section, such configuration of the boundary serving to maintain the high-velocity flow within the confines of the boundary.

DESCRIPTION OF THE PREFERRED EMBODIMENTS

Figure 1:
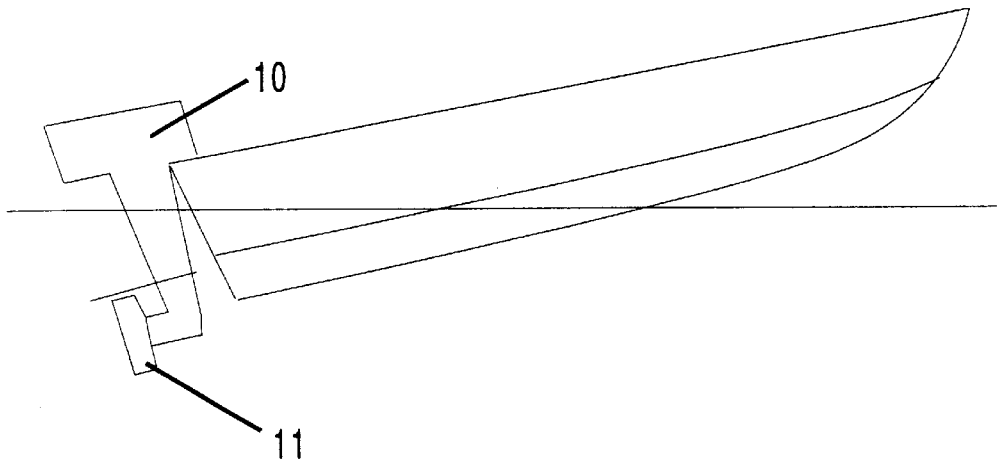
FIG. 1 shows a boat attempting to plane with a poor, high-drag attitude.

FIG. 1 shows a craft attempting to plane with a poor, high-drag attitude. The craft of FIG. 1 is fitted with an outboard motor 10 which drives a propeller 11 and the weight of the motor 10 and associated drive system is such that the craft has a stern-heavy attitude creating high drag.

Figure 2:
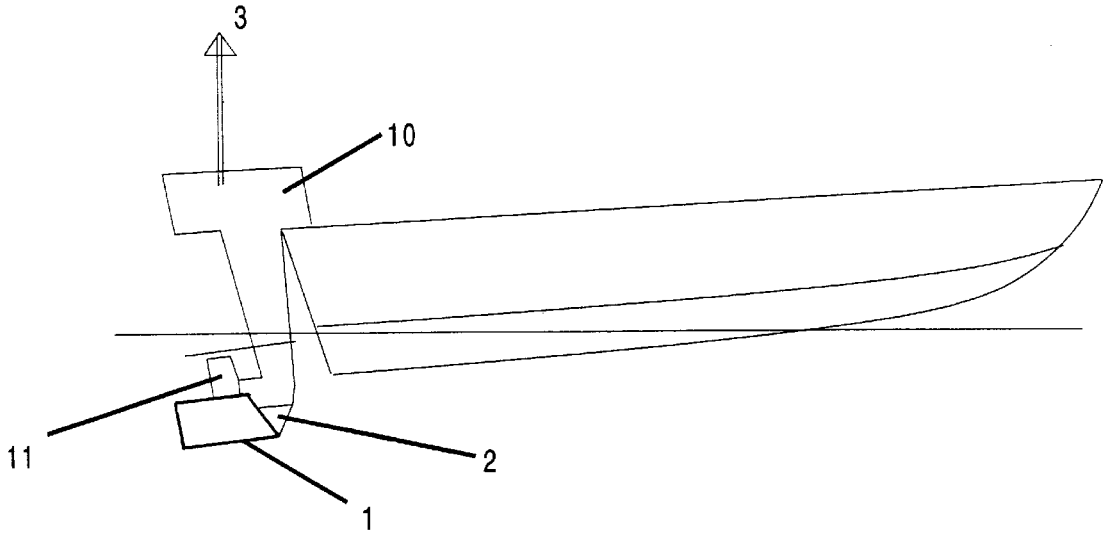
FIG. 2 shows a boat fitted with a lift-generating device in accordance with the present invention.

FIG. 2 shows the craft of FIG. 1 fitted with a lift-generating device 1 in accordance with the present invention. The device 1 is attached at 2 to the underwater part of the propulsion unit and, in operation of the propulsion unit, a lift force is produced which acts in the direction of the arrow 3 of FIG. 1, thereby producing a change in the attitude of the craft and effecting a substantial drag reduction. The device 1 may be attached to the craft at two points; firstly at the skeg of the underwater part of the propulsion unit by means of a skeg clamp, and secondly by two struts to the point where the anodic trim fin of the craft is located.

Figure 3A:
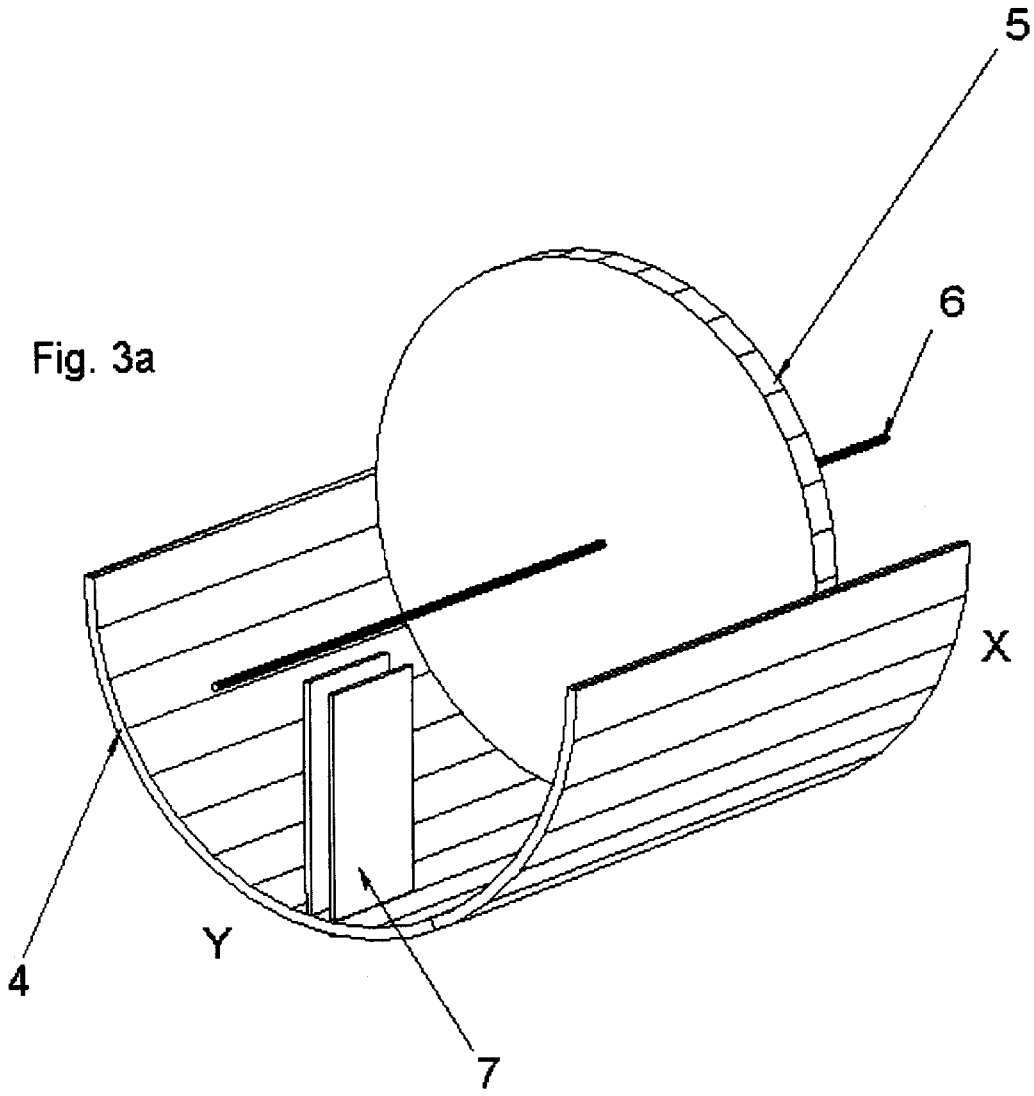
FIG. 3*a* illustrates the mode of operation of the device.

The basic features of a device in accordance with the present invention are illustrated in FIG. 3*a*. The device includes a physical boundary 4 over the upper surface of which a high-speed flow of water is projected. This high-speed water flow is typically (but not exclusively) provided by the main propulsion unit of the craft to which the device 1 is fitted. This propulsion unit is typically (but not necessarily) a propeller of some kind and, in FIG. 3*a*, the propeller is indicated schematically at 5 and the axis about which the propeller rotates is indicated at 6. The boundary 4 is attached to a fixed part of the propulsion unit or to the hull of the craft by a strut illustrated schematically at 7. In operation of the propeller 5, a high-speed stream of water will be caused to flow over the upwardly facing surface of the boundary 4, thereby creating lift.

FIG. 3*a* shows the relationship of the propeller 5 to the boundary 4. It is important, for effective functioning of the device, that the high-speed water flow is in intimate contact with the upper surface of the boundary 4. In the case of propeller-driven marine craft, one way of achieving this goal of intimate contact between the upper surface of the boundary 4 and the high-speed flow is for the boundary to be a sector of a semi-circle wrapped around the locus of the propeller tip below the axis 6 of the propeller shaft, i.e. as illustrated in FIG. 3*a*. The direction of flow produced by operation of the propeller is from the upstream end Y of the boundary 4 to the downstream end X of the boundary 4.

Figure 3B:
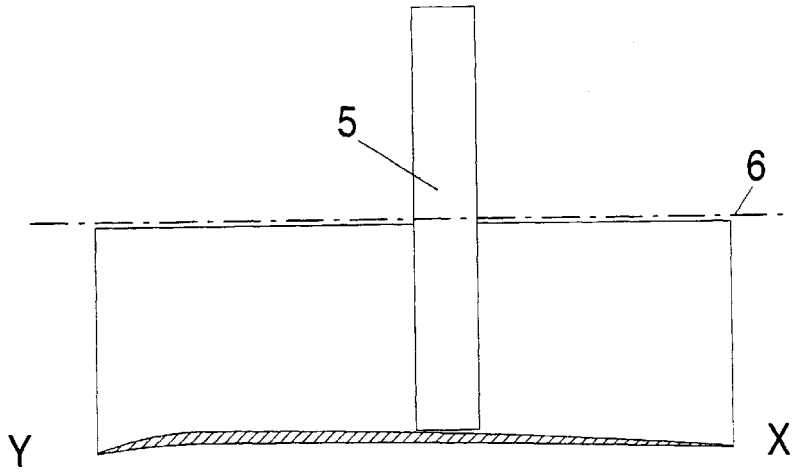
FIGS. 3*b*, 3*c* and 3*d* illustrate alternative device configurations.
Figure 3C:
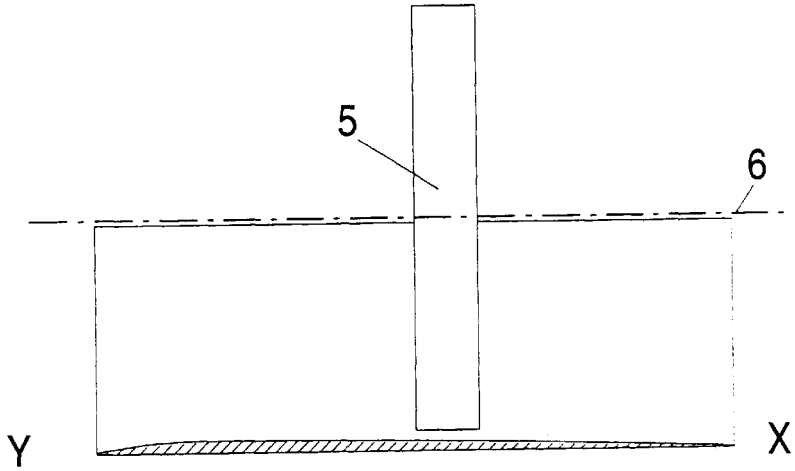
Figure 3D:
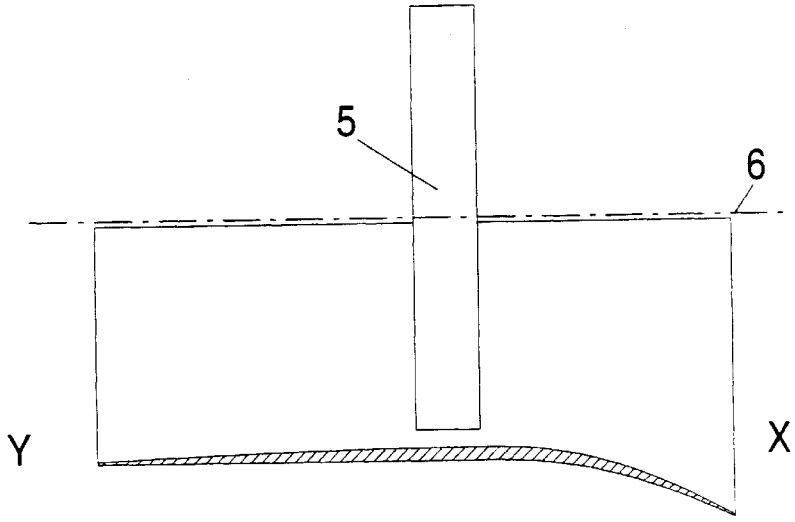

The boundary 4 may be of simple semi-cylindrical form, made of a uniform section plate, as illustrated in FIG. 3*a*. Alternatively, the boundary 4 may have a semicylindrical form with an aerofoil section as illustrated in FIGS. 3*b*, 3*c* and 3*d*. Where the boundary 4 does have an aerofoil section as indicated in FIG. 3*b*, the leading edge of the aerofoil formation should be at the upstream end Y of the boundary 4. If an aerofoil section is employed, it may vary from, effectively, a flat plate with the corners smoothed off, as in FIG. 3*c*, to a highly cambered aerofoil with a pronounced down-curved rear section, as shown in FIG. 3*d*. The boundary 4 must extend both upstream and downstream of the propeller 5, as indicated in each of FIGS. 3*a* to 3*d*, and the propeller 5 may be considered as lying between X and Y, i.e. between the downstream and upstream ends of the boundary 4.

Figure 4A:
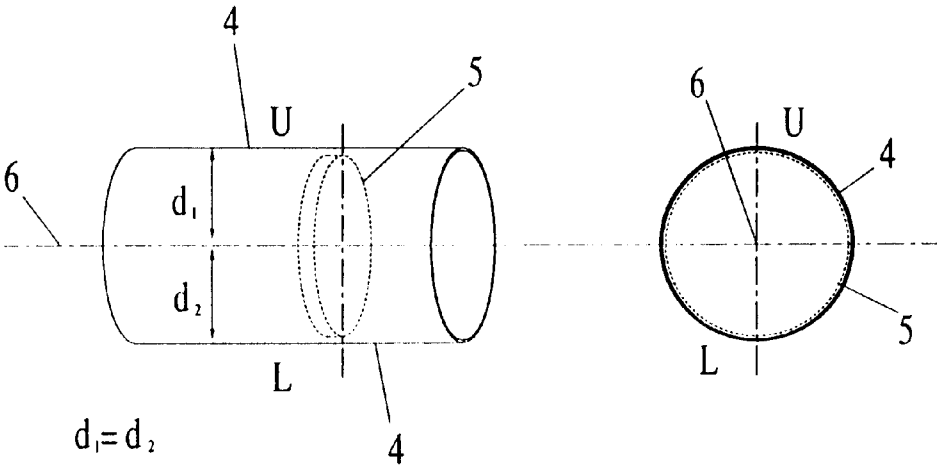
FIGS. 4*a*, 4*b*, 4*c* and 4*d* illustrate conditions which can arise as a result of the use of closed tube or substantially closed tube configurations.

In order to achieve significant net lift, the boundary 4 must not form a completely or substantially closed symmetrical tube around the axis 6 of the propeller shaft, as such features produce an undesirable downforce which tends to cancel the lift force. FIG. 4*a* shows a completely closed tube that is symmetric with respect to the axis 6. In such an arrangement, the lift force will be substantially cancelled by the downforce. The device of the present invention is thus not a symmetrical closed tube device.

Figure 4B:
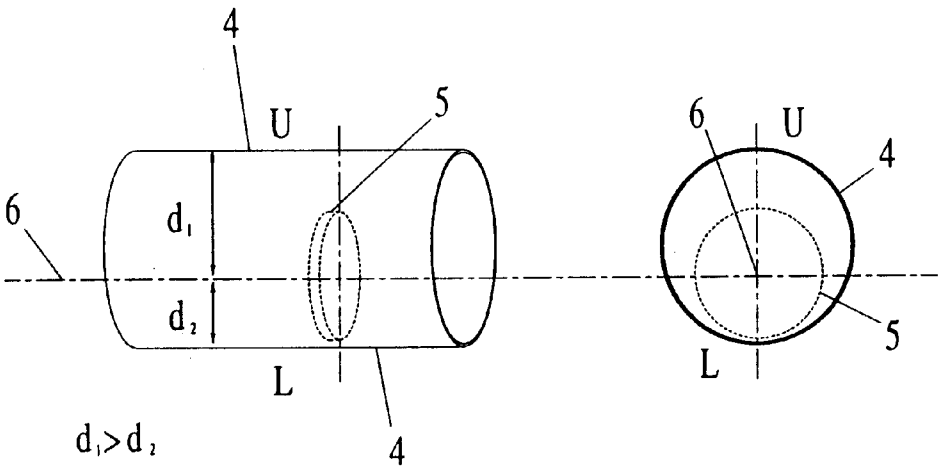
Figure 4C:
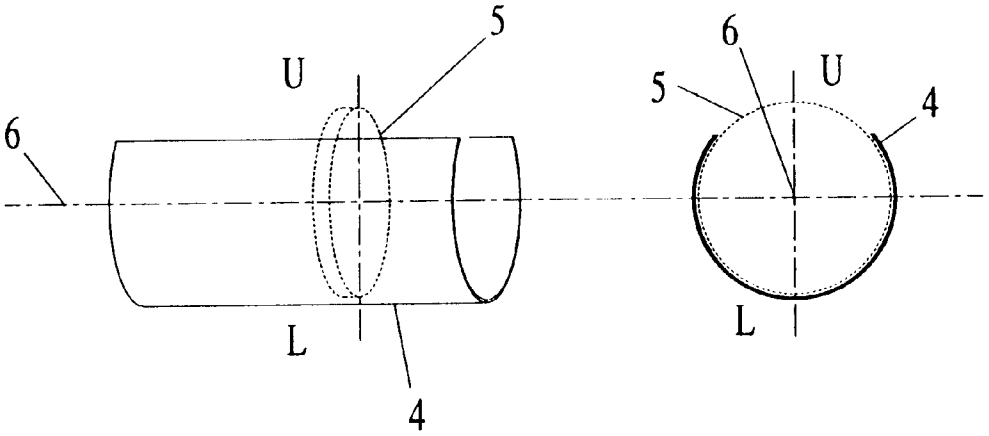
Figure 4D:
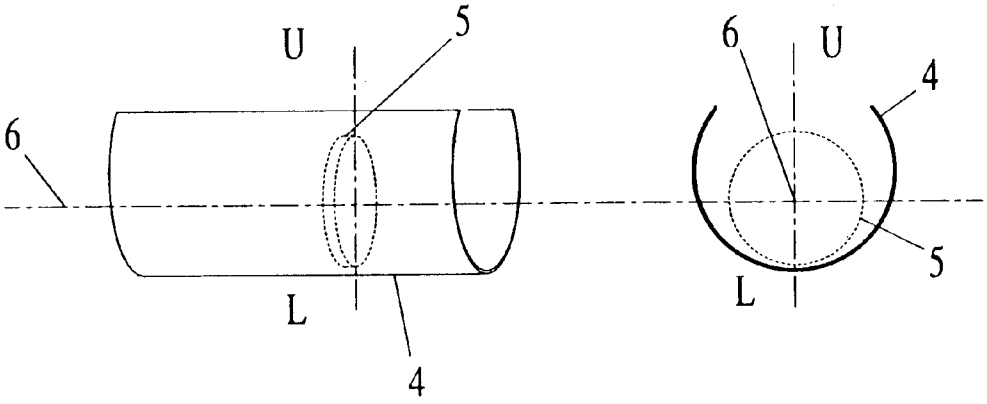

FIG. 4*b* shows a completely closed tube that is asymmetric with respect to the axis 6. FIG. 4*c* shows a substantially closed tube that is symmetric with respect to the axis 6, while FIG. 4*d* shows a substantially closed tube which is asymmetric with respect to the propeller. shaft axis 6. The devices shown in FIGS. 4*b*, 4*c* and 4*d* will produce some lift, but are not preferred forms of the intention.

In each of FIGS. 4*a* to 4*d*, the symbol U is used to denote the side of the tube nearest to the water surface and the symbol L is used to denote the side of the tube furthest from the water surface.

Figure 5:
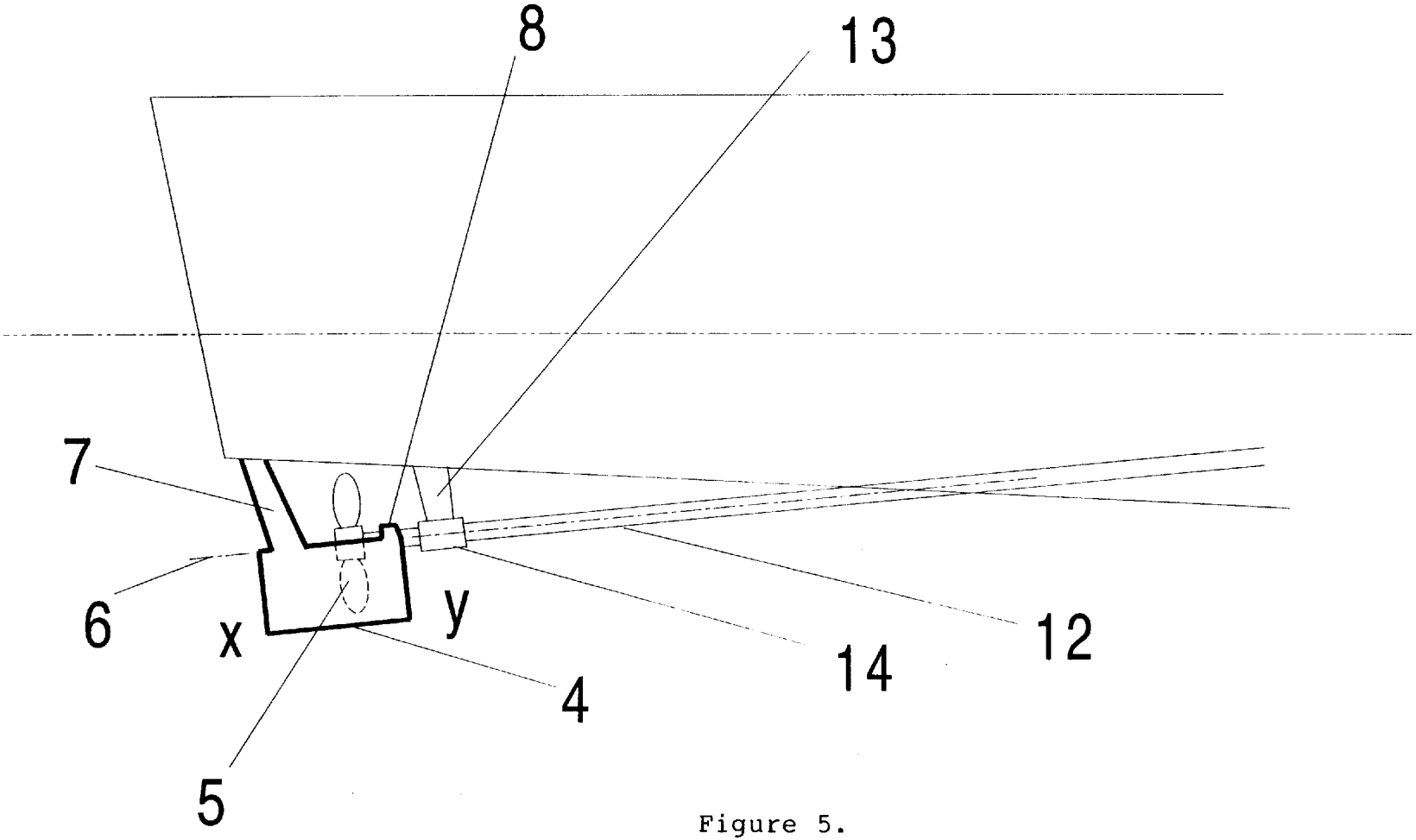
FIG. 5 is a view similar to FIG. 2 but showing an alternative form of lift-generating device attached to the rear of a boat.

FIG. 2 shows a method of attaching the device 1 to an outboard motor drive system (or equivalent stern drive unit), and FIG. 5 shows a method of attachment suited to a shaft drive arrangement. The boundary 4 of the arrangement shown in FIG. 5 is of semi-circular form in cross-section with the axis of the circle coinciding substantially with the axis 6 about which the propeller 5 rotates. The propeller 5 is located between the ends of the boundary 4 being positioned, in this instance, closer to the down-stream end X of the boundary 4.

The propeller 5 is driven by a shaft 12 which is supported by a bearing 14 carried by a strut 13 extending downwardly beneath the hull of the craft. The boundary 4 is connected, adjacent its downstream end, to the hull by a strut 7 and is connected, at its upstream end, to either the shaft bearing 14 or the shaft tube by means of a clamp 8.

Figure 6:
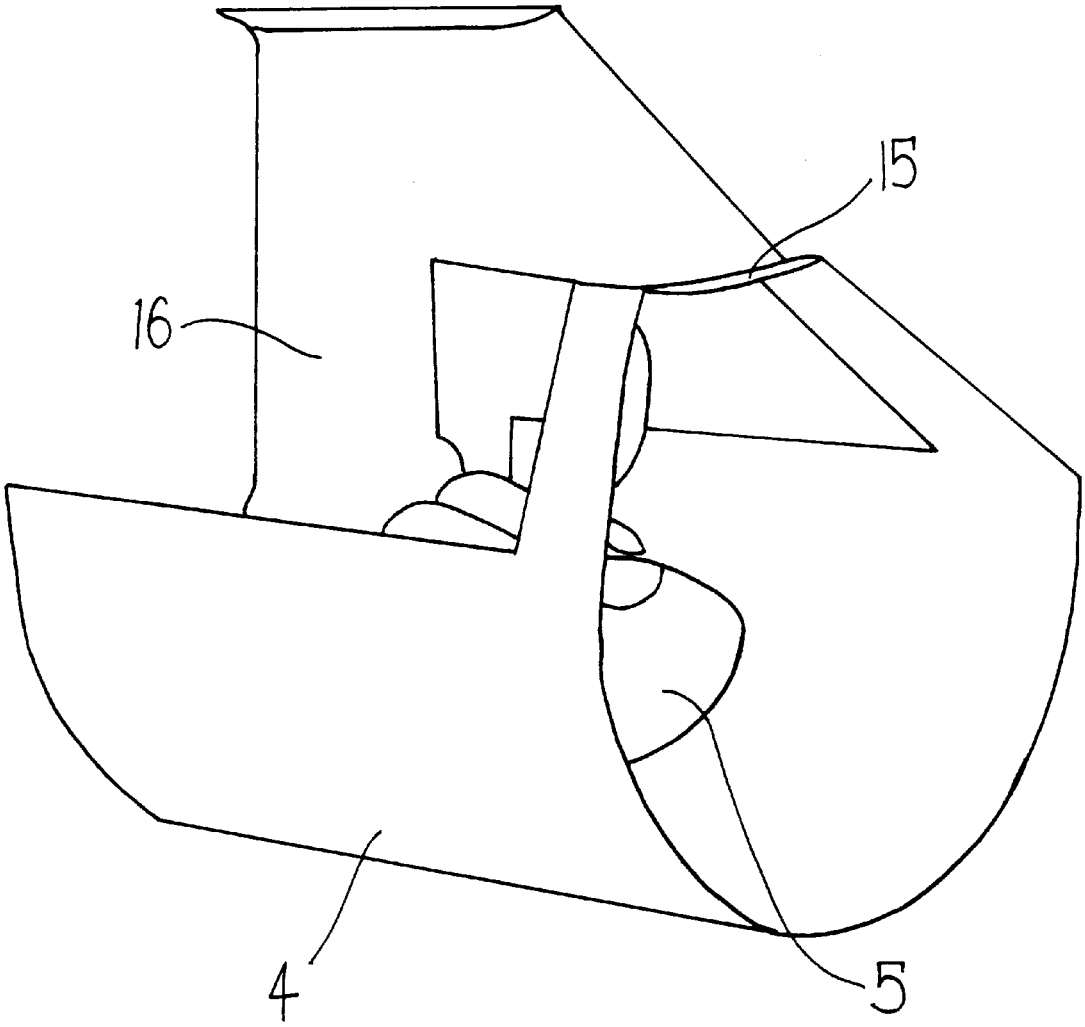
FIG. 6 is a perspective view showing a device fitted to a propulsion unit.
Figure 7:
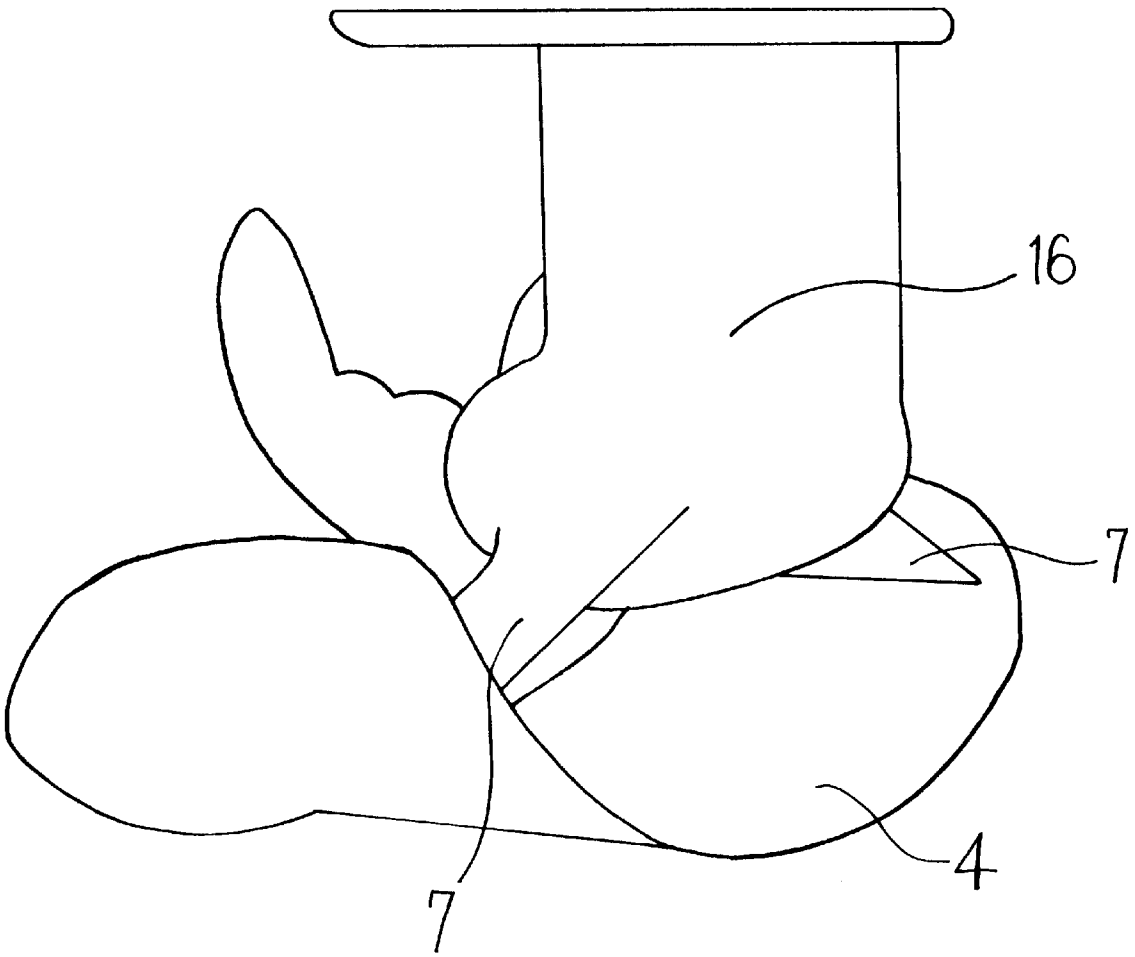
FIG. 7 is a perspective view showing an alternative form of device fitted to a propulsion unit.

In the arrangement shown in FIG. 6, the boundary 4 is in the form of a generally semi-cylindrical element attached, at its downstream end, to a cavitation plate 15 mounted on the leg 16 on which the propeller 5 is carried. In the further arrangement of FIG. 7, the boundary 4 is attached by inclined struts 7 to the gearbox casing 16 of the propulsion unit. The boundary 4, in this instance, has its downstream end downwardly flared, along the lines shown in FIG. 3*d* referred to above.

A variety of methods of attaching the boundary 4 to the propulsion unit may be employed. Such methods will normally include the use of struts or other fixation elements which extend above the axis of the propeller. The high-speed stream of water will thus flow over generally downwardly facing surfaces of the fixation elements. This will inevitably create some undesirable downward force and it is accordingly necessary that the design of the boundary and of such fixation elements should satisfy at least one (and preferably both) of the following criteria:

(1)the total area of any completely or substantially closed sections of the boundary 4 (including struts or other fixation elements) that are above the propeller shaft axis 6 must be kept much less than the total area of the lift-generating regions that are below the propeller shaft axis 6, and (2) any completely or substantially closed sections of the boundary (including struts or other fixation elements) that are above the propeller shaft axis 6 must be asymmetrical with respect to the propeller shaft axis 6, with much larger gaps above the axis 6 than below it, as illustrated in FIGS. 4*b* and 4*d*.

The fixation methods shown in FIG. 3*a* and FIGS. 5 to 7 all satisfy these requirements.

By varying the fine details of the shape of the boundary 4, together with the angle of incidence of the. boundary 4, it is possible for the device of the present. invention to produce any of the following lift/speed characteristics:

(a) the lift is large when the craft to which the device is attached is stationary or moving slowly relative to its operational speed, and (b) the large initial lift may reduce in some manner as the craft speeds up, or (c) the large initial lift may stay constant as the craft speeds up, or (d) the large initial lift may increase as the craft speeds up.

Figure 8A:
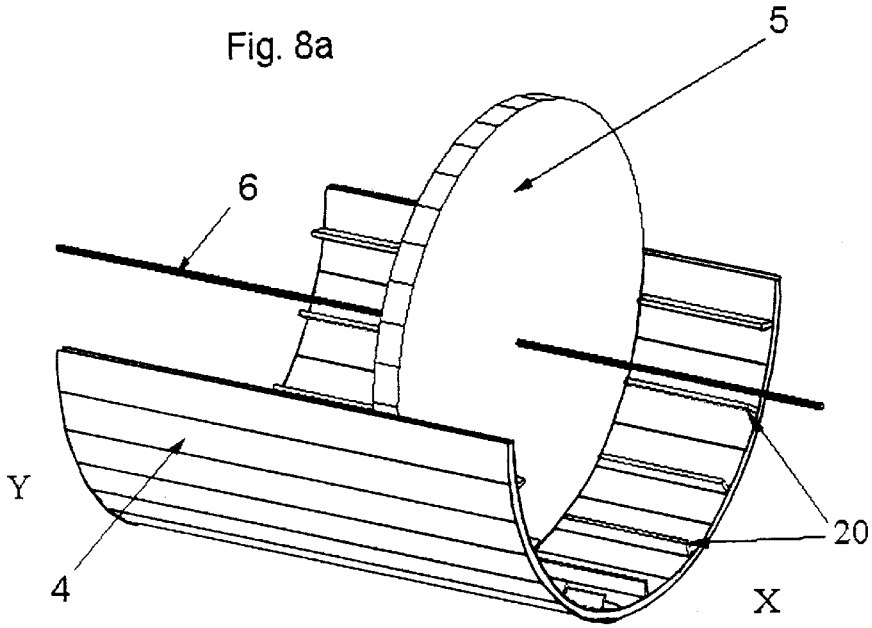
FIGS. 8*a*, 8*b*, 8*c*, 8*d* and 8*e* are views similar to FIG. 3*a* but showing further alternative design variants.
Figure 8B:
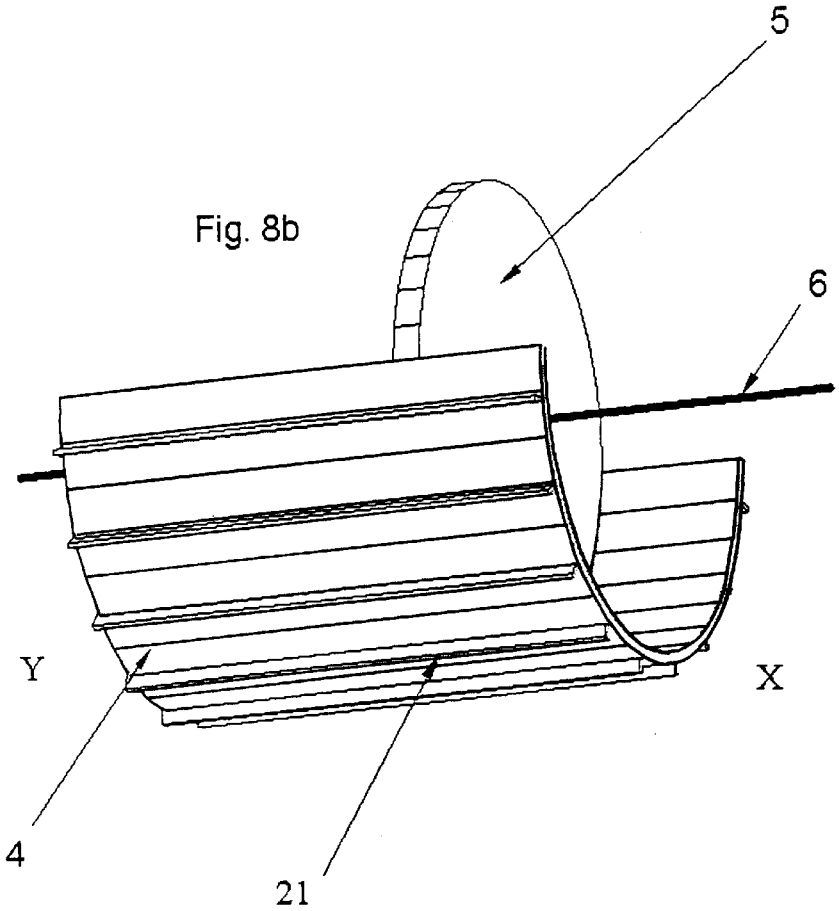
Figure 8C:
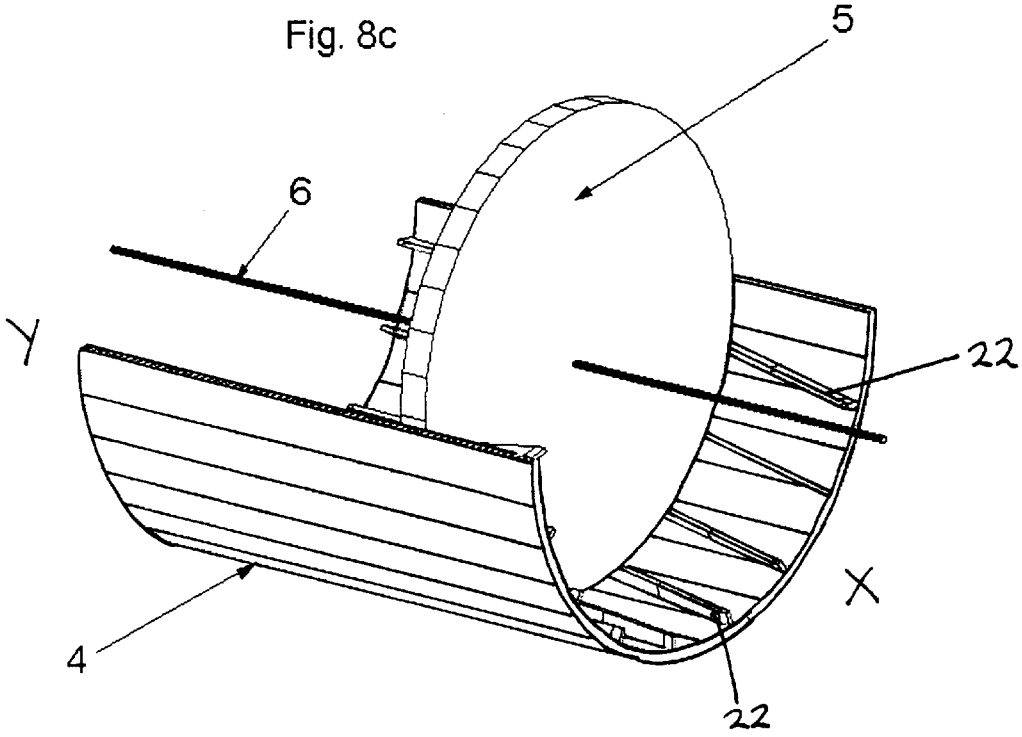
Figure 8D:
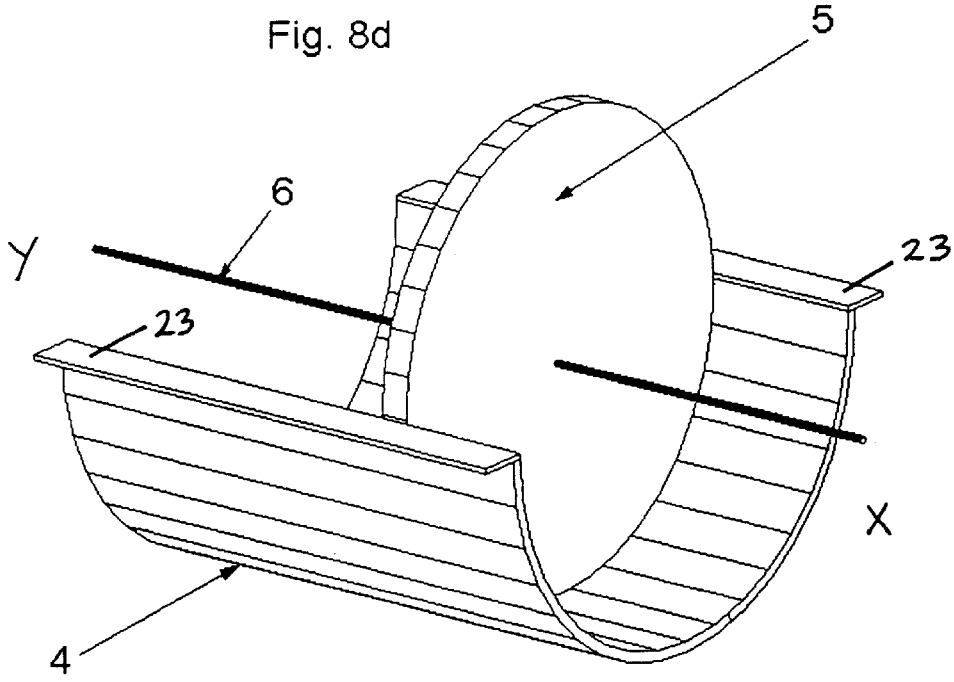
Figure 8E:
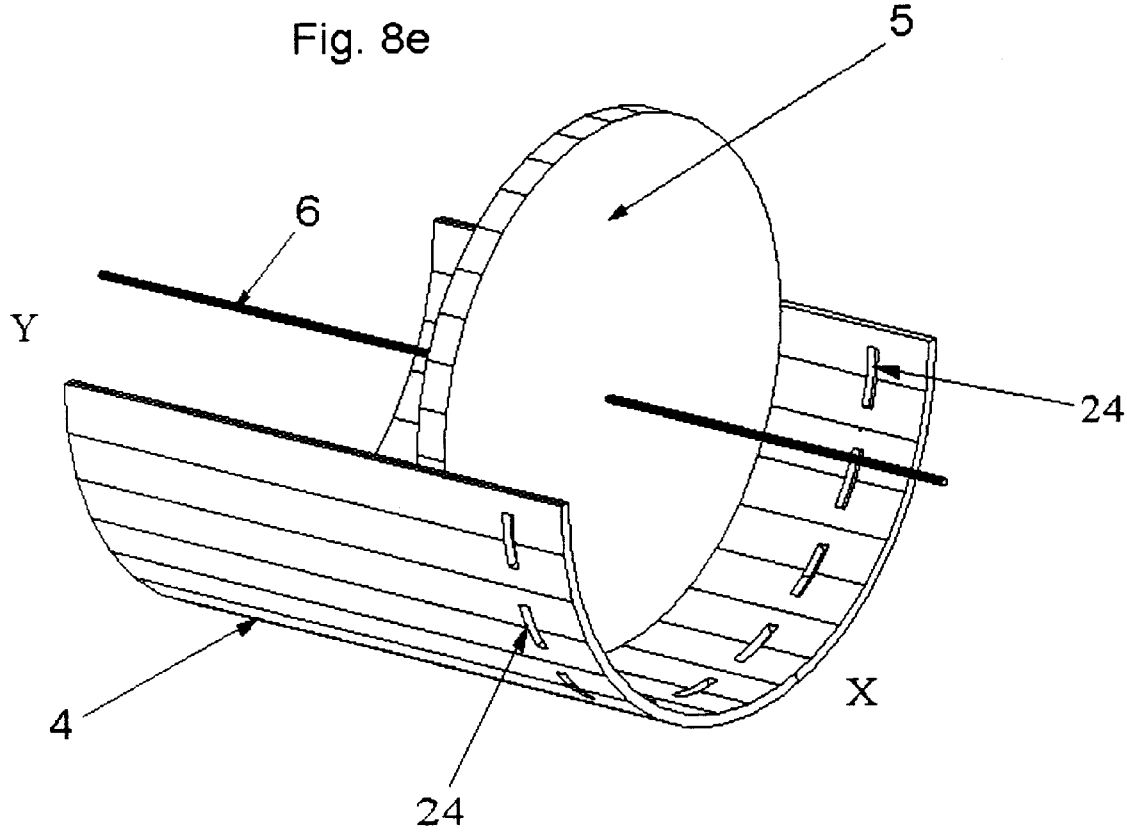

A variety of detailed features, as employed on conventional aeronautical wings, may also be fitted to the boundary 4 to improve or modify its efficiency. Such features include raised strips, strakes, etc., both straight and curved, on the upper or lower or both surfaces of the boundary 4, on the upstream or downstream side of the propeller 5 or on both sides of the propeller. Thus FIG. 8*a* shows the use of straight strips 20 on the upper surface of the boundary 4. FIG. 8*b* shows the use of straight strips 21 on the lower surface of the boundary 4. FIG. 8*c* shows the use of inclined strips 22 on the upper surface of the boundary 4. FIG. 8*d* shows the use of winglets 23, and FIG. 8*e* shows the use of slots 24 adjacent the downstream end X of the boundary 4.

Figure 9:
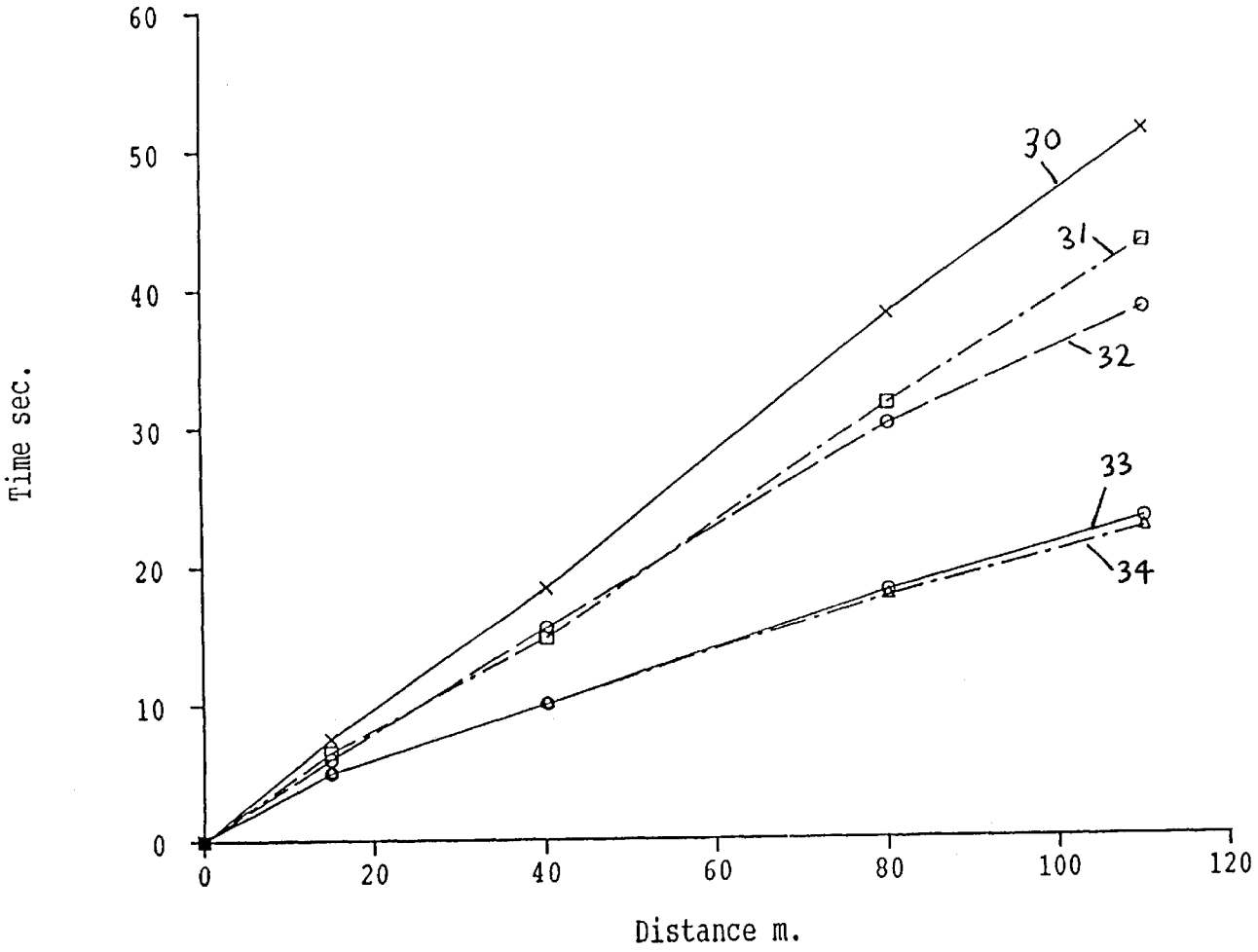
FIG. 9 is a chart showing the effects of use of a device in accordance with the present invention.

FIG. 9 shows the results of trials carried out using an inflatable rubber boat with a shallow V-shaped hull. The overall length of the boat was 3 meters and its beam 1.4 meters. The approximate weight of the boat was 80 kgm. and the power unit of the boat was an 8 Horse Power 2-stroke outboard motor. The crew consisted of two persons each of approximately 80 kgm. in weight. This similarity between the weight of the craft and the weight of each member of the crew made it possible to vary the trim of the craft over a large range by varying the seating positions of the crew.

This craft plus crew loading were chosen for the tests so that the maximum speed of the boat with stern heavy conditions was too low for effective planing, while with very far forward loading some planing action was clearly present. The tests were conducted by timing the distance travelled from a standing start and opening the throttle fully as rapidly as possible from idling at time zero.

Curve 30 shows the results obtained with the crew sitting as far back in the craft as possible to provide a stern heavy condition, and with no device fitted.

Curve 31 shows the results obtained with the crew moving forwards by approximately 0.5 meters towards the centre part of the craft, and with no device fitted.

Curve 32 shows the results obtained with one crew member actually sitting on the bow of the craft while the other crew member, who operated the engine, moved as far forwards as possible while still being able to control the motor, and with no device fitted.

Curve 33 shows the results obtained by fitting the device of the present invention to the craft and repeating the test of curve 30, and curve 34 shows the results obtained by fitting the device of the present invention to the craft and repeating the test of curve 31.

The results of these trials, as demonstrated by the curves of FIG. 9, confirm the ability of the device of the present invention to correct for a poor attitude of a craft and the consequent poor planing ability. They also suggest that the drag penalty of fitting the device is very modest.

The fine details of the mechanical design and selection of materials in a particular implementation of the invention should take notice of force loadings, fatigue and corrosion resistance. Surface finishing should aim to minimise drag.

The applicant is aware that aeronautical devices have been designed in which a high-speed stream of air produced by a propeller or jet engine is blown over the upper surface of a section of a wing. The lift created by wing/flap systems of this type can be several times that realisable from a more conventional wing which is merely positioned in the general slipstream over the aircraft induced by the propulsion device.

With devices using such high-speed, engine-blown air flow, it is also possible (but not necessary) to employ wings with highly cambered airfoil cross-sections that have a very large downturn over the rear section, which would suffer from severe flow detachment or stall without the presence of the blown high-speed air flow.

In contrast with these known devices for aeronautical applications, the device of the present invention is for marine applications and uses water as the working medium. A high lift is produced by the use of a boundary over which a high speed flow of water is created. This high speed flow of water is typically (but not exclusively) produced by the main propulsion unit of the craft. Such main propulsion unit may be a propeller, as illustrated, or a water jet device.

An important advantage of the device of the present invention, as compared with existing marine lift-generating devices used to improve the planing capabilities of a craft, is that it can provide a component of lift which call be a maximum when the vehicle is at rest, or moving slowly, together with the additional option of providing large lift at operational speeds.

The further ability of the device of the present invention to maintain lift at operational speeds (if so desired) allows an improvement in the attitude of the craft, and thus a reduction in its drag, which makes it possible to use less power to maintain a given planing speed. This allows either increased fuel economy or a smaller engine size, or the use of an engine with a lower power to weight ratio, such as a four-stroke petrol or diesel engine. This brings with it an associated advantage in further improved fuel consumption over a two-stroke engine, and cleaner emissions.

The boundary device of the present invention may also be used as a motion control device to regulate behavior such as pitch and roll. In such cases, the source of the high speed flow of water could well be other than the main propulsion unit of the craft.

What is claimed is:

1. A lift-generating device for a boat having a flow generator (5) for generating a high-velocity stream of water, which device includes a boundary (4) having an upwardly facing surface and a downwardly facing surface, means for mounting said boundary so that said high-velocity stream of water is caused to flow over said upwardly facing surface at a velocity greater than any flow of water under the downwardly facing surface of said boundary, and in which the boundary (4) extends both upstream and downstream of the flow generator (5).

2. A device as claimed in claim 1, characterised in that the boundary (4) is so positioned that the flow generator (5) is located closer to the downstream end of the boundary (4) than to the upstream end thereof.

3. A device as claimed in claim 1, characterised in that said boundary (4) is of generally semicircular form about an axis (6).

4. A device as claimed in claim 1, characterised in that said boundary (4) has a pronounced down-curved rear section.

5. A boat fitted with a device as claimed in claim 1.

6. A boat as claimed in claim 5, characterised in that the flow generator (5) is the main propulsion unit of the boat.

7. A method of creating lift for a boat having a flow generator (5) for generating a high-velocity stream of water, which method comprises providing a boundary (4) having an upper surface and a lower surface and positioning the boundary (4) relative to the flow generator (5) in such manner that, in operation of the flow generator (5), the high-velocity stream of water is caused to flow over the upper surface of the boundary (4) at a velocity greater than any flow of water under the lower surface of the boundary (4), characterised in that the boundary (4) is so mounted that it extends both upstream and downstream of the flow generator (5).

8. A method as claimed in claim 7, characterised in that it includes mounting the boundary (4) so that the flow generator (5) is located closer to the downstream end of the boundary (4) than to the upstream end thereof.

9. A method as claimed in claim 8, characterised in that it includes forming the boundary (4) so that it has an aerofoil configuration in longitudinal section.

10. A method as claimed in claim 9, characterised in that the boundary (4) has a pronounced down-curved rear section.

11. A method as claimed in claim 9, characterised in that the flow generator is a propeller (5) which is carried on a leg (16) on which a cavitation plate (15) is mounted and the boundary (4) is attached to the cavitation plate (15).

12. A method as claimed in claim 9, characterised in that the flow generator is a propeller (5) which is carried on a shaft (12) and that the boundary (4) is attached to the shaft (12) and/or to its support (13,14) and to the boat.

* * * * *